US006135845A

United States Patent [19]

Klimpert et al.

[11] Patent Number: 6,135,845

[45] Date of Patent: Oct. 24, 2000

[54] INTERACTIVE TALKING DOLL

[76] Inventors: Randall Jon Klimpert; Ann Danielak Klimpert, both of 320 Isabella, Wilmette, Ill. 60090; David Christianson, 804 Tylerton Cir., Grayslake, Ill. 60030; Dieter Herbstler, 308 Northridge, Bolingbrook, Ill. 60440; Anne Pitrone, 95 Prospect Ter., Tenafly, N.J. 07670

[21] Appl. No.: 09/071,931

[22] Filed: May 1, 1998

[51] Int. Cl.[7] ..... A63H 3/28

[52] U.S. Cl. ..... 446/297; 446/301; 446/304

[58] Field of Search ..... 446/72, 268, 297, 446/298, 300, 301, 304, 337, 397

[56] References Cited

U.S. PATENT DOCUMENTS

| | | | |
|---|---|---|---|
| 3,583,093 | 6/1971 | Glass et al. . | |
| 3,641,496 | 2/1972 | Slavin . | |
| 3,641,703 | 2/1972 | Tepper et al. . | |
| 3,755,960 | 9/1973 | Tepper et al. . | |
| 3,858,352 | 1/1975 | Cummings et al. . | |
| 3,867,785 | 2/1975 | Ryan et al. . | |
| 3,904,210 | 9/1975 | Licitis . | |
| 3,918,199 | 11/1975 | DeMasi | 446/301 |
| 4,017,905 | 4/1977 | Covertine et al. . | |
| 4,231,184 | 11/1980 | Corris et al. | 446/297 |
| 4,249,338 | 2/1981 | Wexler | 446/301 |
| 4,294,033 | 10/1981 | Terzian . | |
| 4,318,245 | 3/1982 | Stowell et al. . | |
| 4,451,911 | 5/1984 | Klose et al. . | |
| 4,696,653 | 9/1987 | McKeefery . | |
| 4,805,328 | 2/1989 | Mirahem . | |
| 4,840,602 | 6/1989 | Rose . | |
| 4,857,030 | 8/1989 | Rose . | |
| 4,923,428 | 5/1990 | Curran . | |
| 5,037,345 | 8/1991 | Nakayama | 446/297 |
| 5,094,644 | 3/1992 | Kelley | 446/305 |
| 5,190,492 | 3/1993 | Berenguer | 446/301 |
| 5,201,683 | 4/1993 | Ferri . | |
| 5,250,003 | 10/1993 | Ferre | 446/301 |
| 5,290,198 | 3/1994 | Nakayama | 446/297 |
| 5,368,308 | 11/1994 | Darnell . | |
| 5,376,038 | 12/1994 | Arad et al. | 446/297 |
| 5,413,516 | 5/1995 | Lam . | |
| 5,443,388 | 8/1995 | Jurmain et al. | 446/297 |

*Primary Examiner*—Sam Rimell
*Attorney, Agent, or Firm*—Wolf, Block, Schorr and Solis-Cohen LLP; Kenneth R. De Rosa

[57] ABSTRACT

A toy doll includes a body having an opening simulating a mouth and first and second electrical switches, each switch being disposed proximal to the simulated mouth and activatable by an object inserted at least partially into the mouth. A speaker is attached to the body. An electrical circuit including an integrated circuit chip is electrically connected with the switches and with the speaker. A base configured as a feeding tray is disposed externally of and is detachably connected with the body. The base has three external switches electrically connected with the circuit chip. The circuit chip has a plurality of memory registers, each register storing a separate signal corresponding to a separate audio message. The chip is configured to randomly select a prompt signal from the memory registers and to transmit the stored signal to the speaker. The prompt signal prompts the user to select a specified one of the switches. The chip is also configured to compare the selected switch with the specified switch. Further, the chip is configured to transmit a first message to the speaker when the specified switch is activated and a second message when a switch other than the specified switch is activated. The first message informs the user that the selection was correct and the second message informs the user that the selection was incorrect.

23 Claims, 9 Drawing Sheets

INTERACTIVE TALKING DOLL

BACKGROUND OF THE INVENTION

The present invention relates to toy dolls, and more particularly, to electronic talking toy dolls having interactive features.

Toy dolls having the means to simulate talking or speaking to a user are well known. For example, U.S. Pat. No. 3,583,093 of Glass et al. discloses a toy doll having a phonographic turntable driven by an electrical circuit that is connected to a switch mounted within the mouth of the doll. When a user inserts a cup within the doll's mouth, the switch is activated and causes the phonograph to produce sounds such that the doll simulates the noise of a baby drinking a bottle. Further for example, U.S. Pat. No. 5,290,198 of Nakayama discloses a toy doll having a digital circuit storing numerous signals that, when sent to a speaker, produce various sounds including that of a baby drinking a bottle. A switch mounted within the mouth of the doll is activated by insertion of a simulated baby bottle, causing the digital circuit to send an appropriate signal to the speaker.

Toy dolls having integrated circuits, particularly integrated circuit chips, are also known, such as the dolls disclosed in U.S. Pat. No. 4,857,030 of Rose and U.S. Pat. No. 4,451,911 of Klose et al. Rose discloses a toy doll having a an integrated circuit chip storing several audio messages simulating spoken sentences, a radio transmitter and a radio receiver connected with the chip. The doll is preferably used with another identical doll such that each doll transmits radio signals (via the radio transmitter) to the other doll. The signals sent by one doll are received by the other doll and transmitted to its chip such that the chip selects an appropriate response from the stored messages, which is then transmitted and received by the one doll.

Klose et al. disclose a toy doll having a microprocessor storing numerous audio messages which is connected by appropriate means to numerous switches attached at various locations on the torso of the toy doll. The microprocessor selects a message, which is then transmitted by a speaker, such that the user is prompted to take an action that will result in a specific switch being activated. A correct action causes the proper switch to be activated.

Although previously known dolls, such as those described above, have provided some interactivity with a user, it is desirable to provide a toy doll that has greater interactivity with the user than these known dolls. Further, it is also desirable to provide a toy doll that recognizes and requests numerous different items of food.

SUMMARY OF THE INVENTION

In one aspect, the present invention is a toy doll interactive with a user. The doll comprises a body having an opening simulating a mouth. Two activatable electrical switches are disposed proximal to the simulated mouth. A speaker is attached to the body. An electrical circuit is electrically connected with the switches and with the speaker and is configured to transmit a first signal to the speaker when one of the two switches is activated and a second signal to the speaker when another of the two switches is activated.

In another aspect, the present invention is a toy doll comprising a body and a base. The base is disposed externally of and detachably connected with the body and has an activatable electrical switch. A speaker is attached to either the body or the base. An electrical circuit is connected with the switch and with the speaker and configured to transmit a signal to the speaker when the switch is activated.

In yet another aspect, the present invention is a toy doll interactive with a user. The doll comprises a body and a speaker connected with the body. Two activatable electrical switches are connected with the body. An electrical circuit is connected with the two switches and with the speaker. The circuit is configured to transmit a first electrical signal to the speaker such that the speaker transmits an audio message prompting the user to activate a specified one of the two switches. The circuit is also configured to compare an activated one of the two switches with the specified switch. Further, the circuit is configured to transmit a second signal to the speaker when the activated switch corresponds to the specified switch and a third signal to the speaker when the activated switch is one of the two switches other than the specified switch.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments which are presently preferred. It should be understood, however, that the invention is not limited to the precise arrangements and instrumentalities shown. In the drawings.

DETAILED DESCRIPTION OF THE INVENTION

Figure 1:
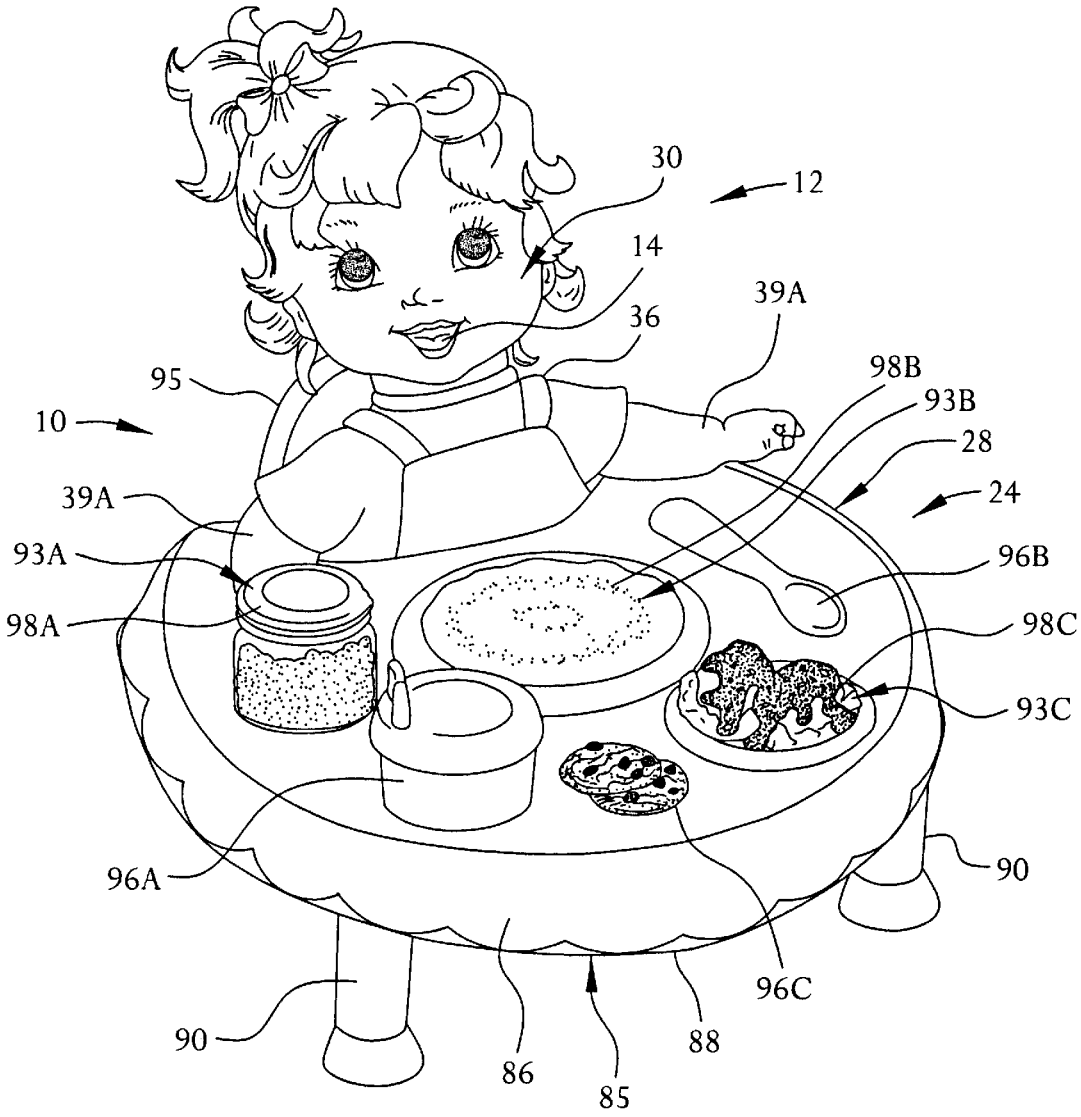
FIG. 1 is a stylized perspective view of a toy doll and feeding tray base in accordance with the present invention.

Certain terminology is used and the following description for convenience only and is not limiting. The words "right", "left", "lower", "upper", "upward", "down" and "downward" designate directions in the drawings to which reference is made. The words "front", "frontward", "rear" and "rearward" refer to directions toward and away from, respectively, a designated front section of a toy doll as described below. The words "inner", "inward", "outer" and "outward" refer to directions toward and away from, respectively, the geometric center of either the toy doll or a particular component thereof, as will be apparent from the context of the description. The terminology includes the words above specifically mentioned, derivatives thereof, and words of similar import.

Referring now to the drawings in detail, wherein like numerals are used to indicate like elements throughout, there is shown in FIGS. 1–20 a presently preferred embodiment of an interactive talking toy doll 10. The toy doll 10 primarily comprises a body 12 having an opening 14 simulating a mouth. Two activatable electrical switches 16, 18 are disposed proximal to the simulated mouth 14. A speaker 20 is attached to the body 12. An electrical circuit 22 is connected with the switches 16, 18 and with the speaker 20. The electrical circuit 22 is configured to transmit a first signal to the speaker 20 when the first switch 16 is activated and a second signal to the speaker 20 when the second switch 18 is activated, such that the doll 10 recognizes at least two different objects inserted at least partially into the simulated mouth 14.

Further, a base 24 is disposed externally of and is detachably connected with the body 12. The base 24 has an external electrical switch 26 connected with the circuit 22. The electrical circuit 22 is also configured to transmit a signal to the speaker 20 when the switch 26 is activated. Preferably, the base 24 is constructed as a feeding tray assembly 28 containing simulated items of food (described below) and having a seat 95 attached thereto. Each of the above-recited components of the toy doll 10 is described in detail below.

Figure 2:
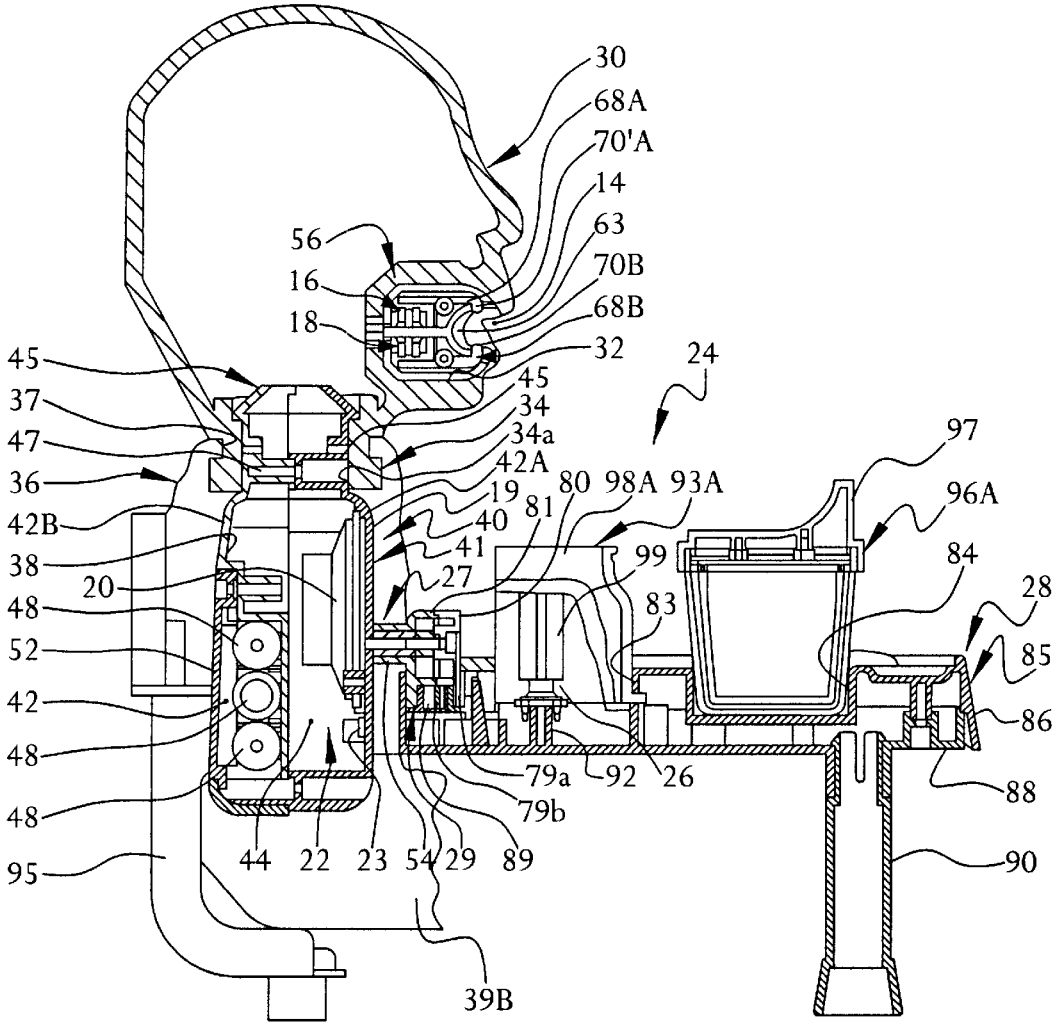
FIG. 2 is a side cross-sectional view of the toy doll shown attached to the feeding tray base.

Referring to FIGS. 1 and 2, the body 12 of the toy doll 10 includes a generally hollow head 30 which includes the opening 14. The opening 14 leads into a mouth cavity 32 within which is disposed a mouth-switch assembly 56 as described in detail below. The head 30 includes a lower circular collar portion 34 adapted for attachment to a generally pliable torso 36. The torso 36 includes a body cavity 38 and has an upper opening 37 leading into the cavity 38 into which the collar 34 of the head 30 is inserted. Preferably, the upper portion of the torso 36 surrounds the lower end of the collar 34 and is attached thereto by means of a tie-band (not shown).

Further, two arms 39A and two legs 39B (only one shown) are attached to the torso 36 at appropriate locations. Preferably, the head 30 is molded of natural or synthetic rubber and the torso 36 is constructed of a suitable fabric, such as for example, woven cotton or polyester, filled with an appropriate stuffing material, such as for example, polyester "fiber-fill". Further, at least the extremities of the arms 39A and legs 39B are formed of molded natural or synthetic rubber.

Although the various components of the body 12 of the doll 10 are preferably constructed as described from the specified materials, it is within the scope of the present invention to construct any portion(s) of the body 12 in any other appropriate manner and from any other suitable material, as long as the toy doll 10 is capable of functioning as described above and in further detail below.

Figure 3:
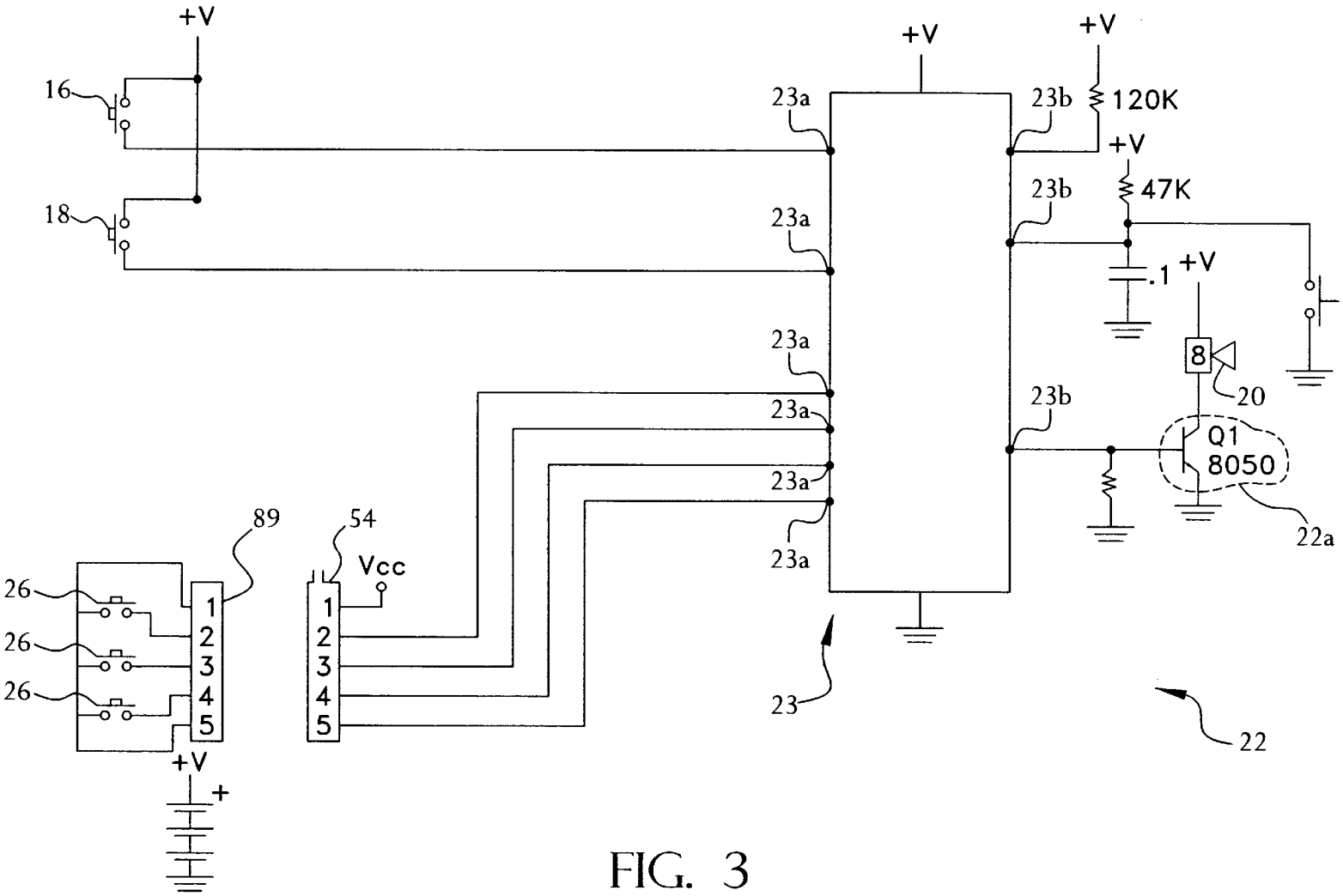
FIG. 3 is a schematic diagram of a preferred electrical circuit used with the toy doll.

Referring now to FIGS. 2–7, preferably, the toy doll 10 includes a primary electrical assembly 40 disposed within the body cavity 38 of the torso 36. The electrical assembly 40 includes a housing 41, the speaker 20 and the primary portions of the electrical circuit 22, specifically an integrated circuit chip ("IC chip") 23 and conductive wires and/or printed circuit board conduits (neither shown). Although the circuit 22 is preferably contained primarily within the IC chip 23, as depicted in FIG. 3, it is within the scope of the present invention to alternatively construct the circuit 22 as discrete electronic components (not shown) or any other type of circuit (not shown), as long as the toy doll 10 is capable of functioning as described above and in further detail below.

Preferably, the speaker 20 and the IC chip 23 are enclosed within the housing 41, although these components may alternatively be attached (not depicted) to external portions of the housing 41. As shown in FIG. 3, the IC chip 23 has a plurality of input ports 23*a* and a plurality of output ports 23*b*, the speaker 20 being electrically connected with one of the output ports 23*b* by conductive wiring (not shown). As speakers and IC chips are well known in both the electrical and toy arts, a detailed description of these components is beyond the scope of the present disclosure. The configuration of the electrical circuit 22 (including the IC chip 23) is described in further detail below.

Preferably, the housing 41 is a two-piece structure formed of front and rear housing halves 42A, 42B. The housing halves 42A, 42B are preferably assembled together by threaded fasteners (not shown) extending through counterbored holes 45 in the front housing half 42A and into threaded holes 47 in the rear housing half 42B. Alternatively, the housing halves 42A, 42B may be assembled together by any other appropriate means, such for example with adhesives, rivets, a friction fit, by complementary interlocking portions, etc. Each housing half 42A, 42B is formed as a generally rectangular shell half including an upper semicircular neck portion 43A, 43B, respectively, such that a generally circular mounting post 45 is formed when the halves 42A, 42B are assembled together. The post 45 extends into a bore 34*a* through the collar 34 to secure the head 30 of the doll 10 to the torso 36. However, the housing halves 42A, 42B may alternatively be constructed without the upper neck portions 43A, 43B, such that housing 40 is completely enclosed within the cavity 38 and the head 30 is attached to the torso 36 merely by the attaching the upper portion of the torso 36 as described above.

Figure 4:
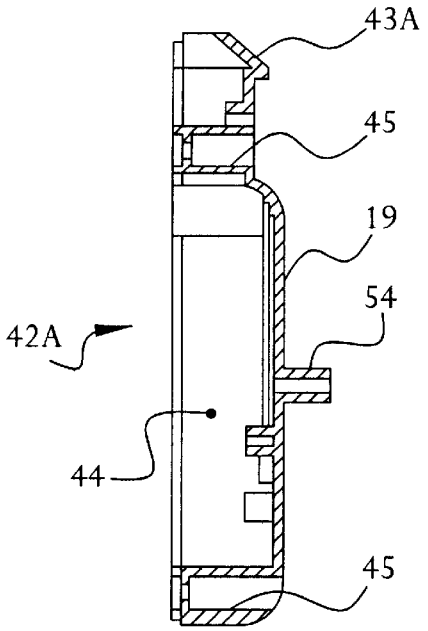
FIG. 4 is a side cross-sectional view of a front electrical housing half having a chip & speaker compartment.
Figure 5:
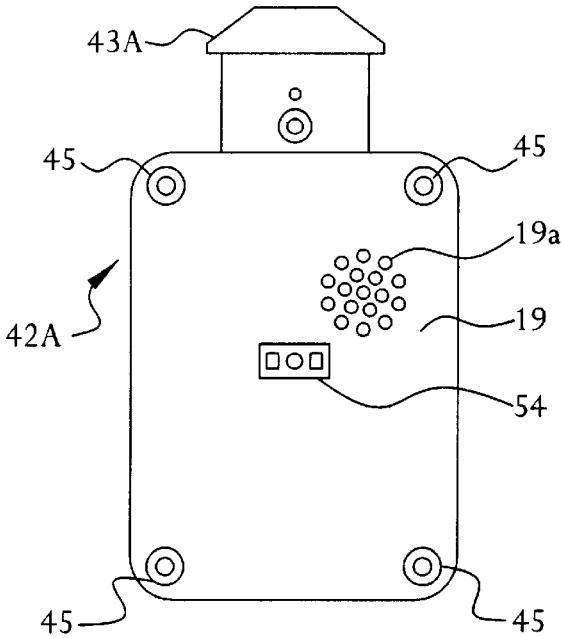
FIG. 5 is a front plan view of the front housing half.

Referring particularly to FIGS. 2, 4 and 5, the front housing half 42A has a portion bounding a chip & speaker compartment 44 within which the speaker 20 and the IC chip 23 are disposed. Most preferably, both the speaker 20 and the chip 23 are attached to separate portions of a front vertical mounting wall 19 of the front housing half 42A by appropriate means, such as with threaded fasteners or adhesives. The mounting wall 19 preferably includes a plurality of sound holes 19*a* extending therethrough over which the sound output portion of the speaker 20 is disposed. Further, an electrical plug 54 extends from the outer surface of the mounting wall 19 and is electrically connected with the electrical circuit 22 by appropriate means.

Figure 6:
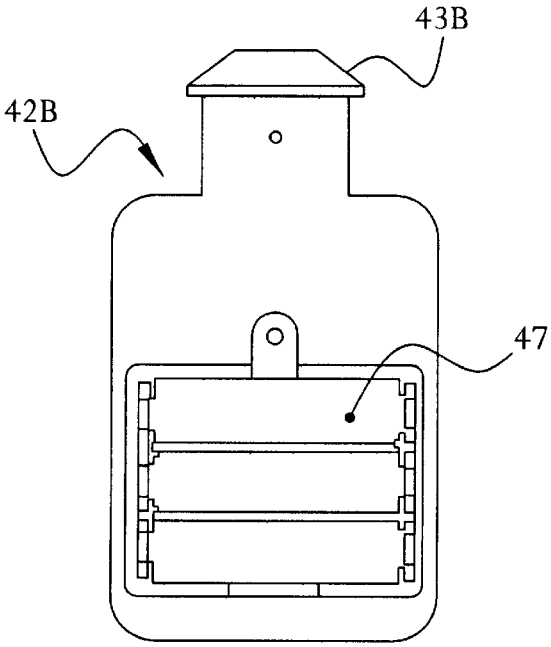
FIG. 6 is a front plan view of a rear electrical housing half having a battery compartment.
Figure 7:
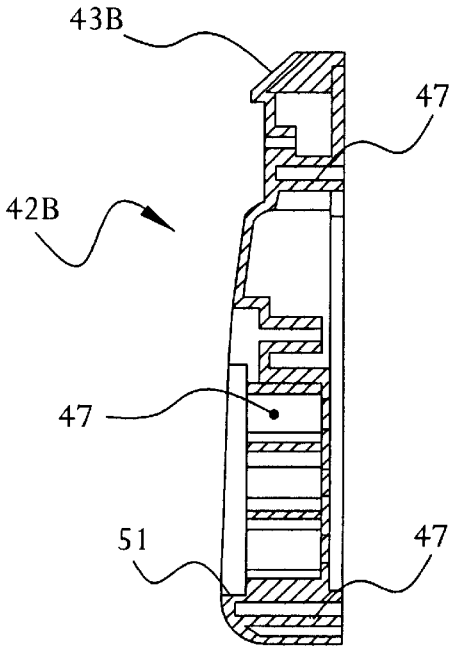
FIG. 7 is a side cross-sectional view of the rear housing half.
Figure 8:
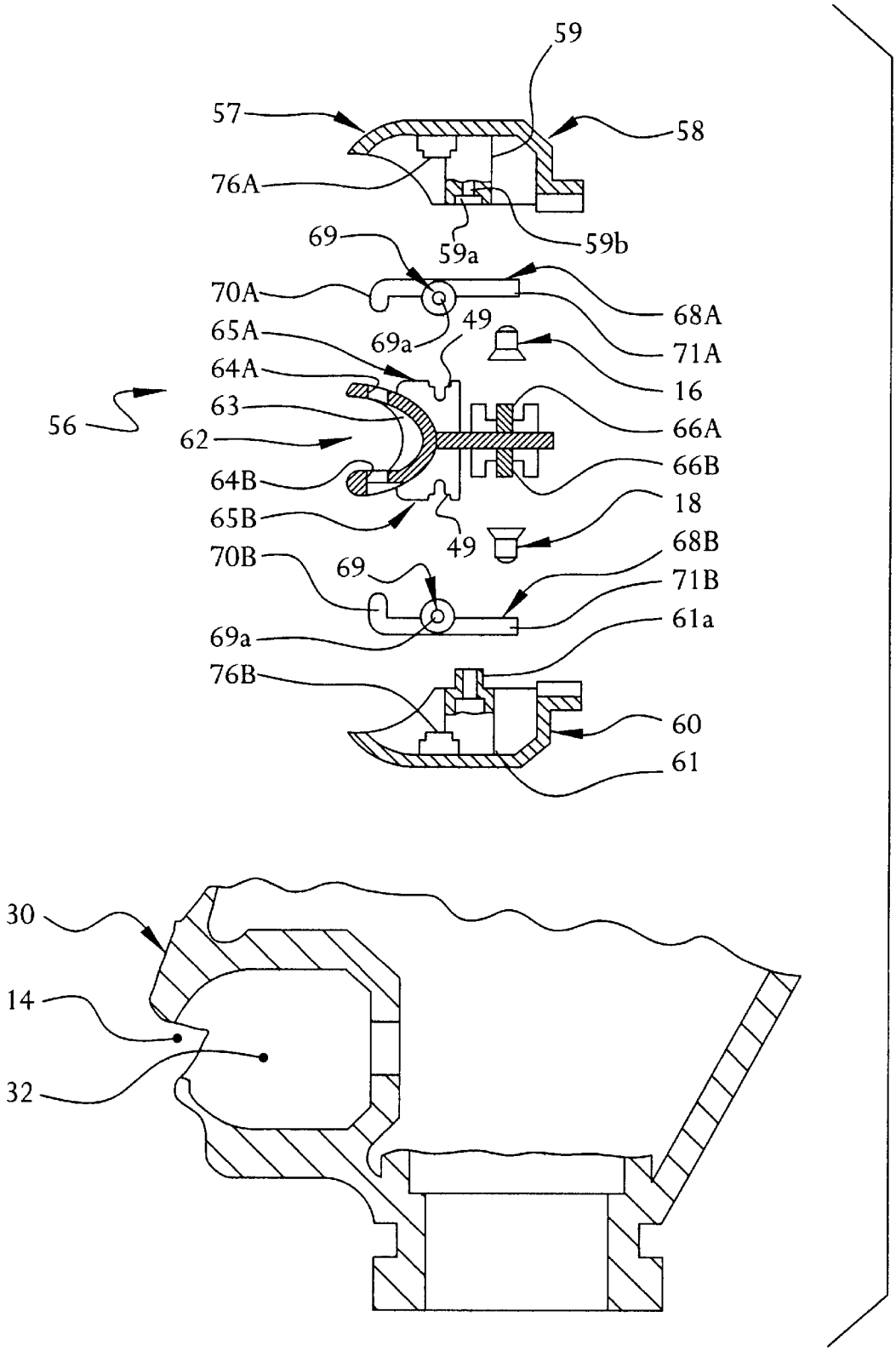
FIG. 8 is a side, exploded view of a mouth switch assembly shown in cross-section.
Figure 9:
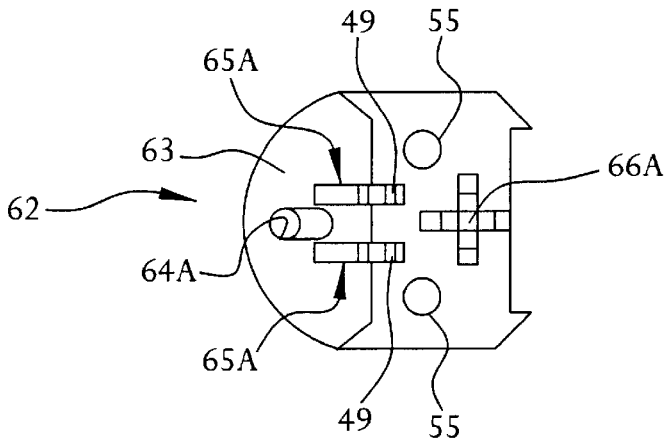
FIG. 9 is a top plan view of a switch frame.
Figure 10:
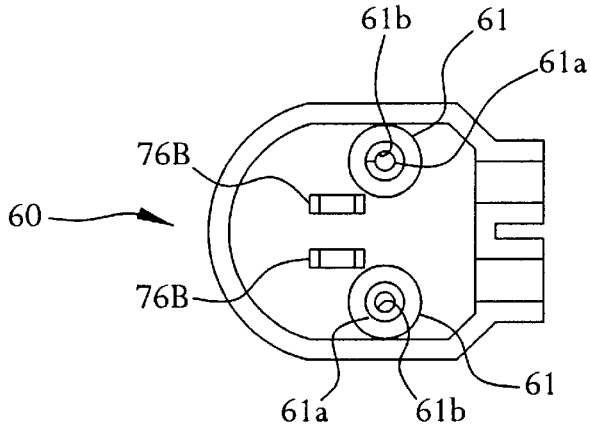
FIG. 10 is a top plan view of a lower switch housing shell half.
Figure 11:
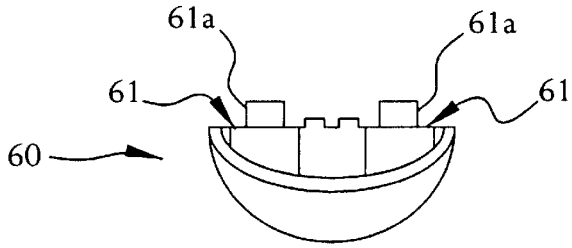
FIG. 11 is a front plan view of the lower switch shell half.
Figure 12:
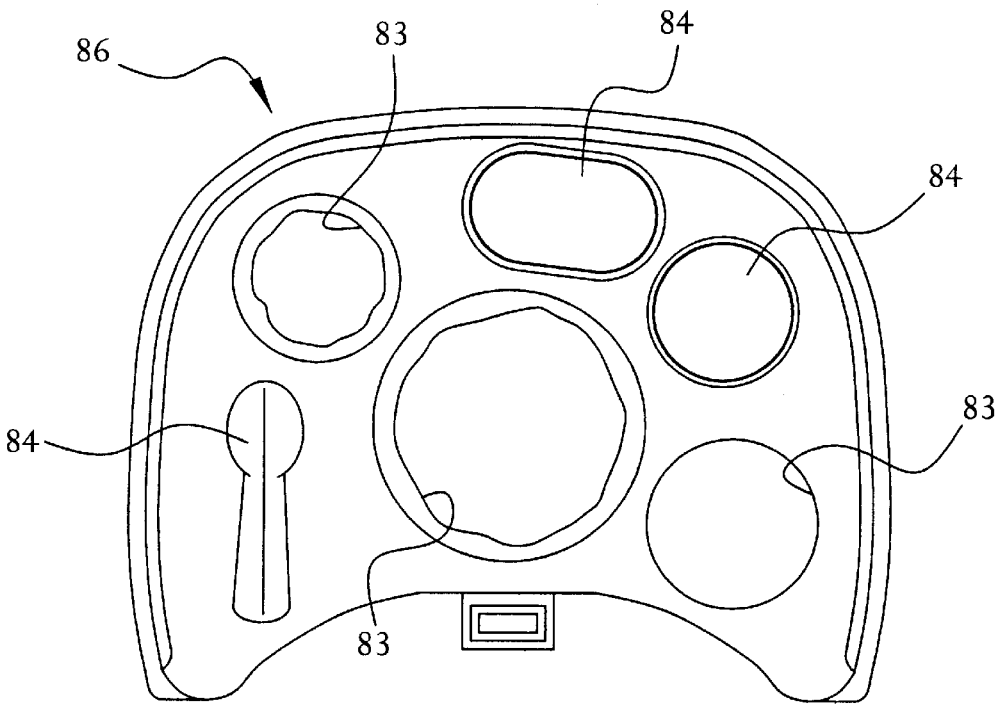
FIG. 12 is a top plan view of the upper half of the feeding tray assembly.

Referring now specifically to FIGS. 2, 6 and 7, the rear housing half 42B includes a power supply compartment 47 for containing either a source of direct current, preferably one or more batteries, or the means for connecting with a source of alternating current, such as a power convertor (not shown) and a connected plug or socket (neither shown). Most preferably, the power supply compartment 47 is sized to contain three commercially available "AA"-type batteries 48 and includes electrical contacts (not shown) to electrically connect the batteries 48 with the electrical circuit 22. The batteries 48 provide power to the circuit 22 which is necessary to operate the IC chip 23 and the speaker 20. Alternatively, the power supply compartment 47 may be configured to contain any other appropriate number of batteries of any appropriate type, such as for example four "AA" batteries or a single "9-volt" type battery (not shown) with appropriate voltage regulators.

Further, the rear housing half 42B preferably includes a removable cover 52 (FIG. 2) enclosing an access opening 51 into the power supply compartment 47 to enable replacement of the batteries 48. Although the electrical circuit 22 is preferably configured such that the batteries 48 remain continuously connected "in-circuit" with the IC chip 23 and the speaker 20 (as described below), the doll 10 may alternatively include an "on-off" switch (not shown) mounted to the rear shell half 42B and configured to connect and disconnect the batteries 48 with/from the IC chip 23 and the speaker 20.

Referring now to FIGS. 2 and 8–11, the first and second switches 16, 18 are preferably disposed within a switch assembly 56 (described below) located within the mouth cavity 32 of the head 30. The switches 16, 18 are preferably commercially available, electromechanical "push-button" type switches having a movable conductive member (not shown) and a stationary conductive member (not shown), such that the switch 16, 18 is closed and a voltage (i.e. from the batteries 48) is applied to one of the input ports 23*a* of the IC chip 23 when the movable member contacts the stationary member. Preferably, the switches 16, 18 are structurally similar to the external switches 26 as described below and depicted in FIG. 15. As electrical switches are well known in both the electronics and toy arts, a more detailed description of the switches 16, 18 is unnecessary and beyond the scope of the present disclosure. Alternatively, the switches 16, 18 may be any other known, appropriate type of switch, such as for example, inductive proximity-type switches (not shown) if the doll 10 is used with simulated food objects and/or utensils having metallic portions.

The switch assembly 56 includes a housing 57, formed of upper and lower shell halves 58, 60, which encloses and supports a switch frame 62. The frame 62 is preferably of one-piece construction and has a front "mouth" portion 63 formed with a partially hemispherical shape so as to simulate the inner walls of a human mouth. The mouth portion 63 has an upper through-hole 64A and a lower through-hole 64B extending through the upper and lower portions thereof, the functions of which are described below. Further, the frame 62 has an upper and a lower switch mounting peg 66A, 66B, respectively, that each extend outwardly from rearward upper and lower portions of the frame 62. Each switch 16, 18 is mounted onto the a separate one of the pegs 66A, 66B, respectively, and is electrically connected in the circuit 22 by appropriate means, such as for example by pairs of conductive wires (not shown) extending between the pegs 66A, 66B and the electrical housing 40. Furthermore, the frame 62 also includes an upper pair of pivot supports 65A and a lower pair of pivot supports 65B (only one shown), the purpose of which is described below.

The mouth switch assembly 56 further includes an first actuating lever 68A pivotally mounted within the upper pair of pivot supports 65A and a second actuating lever 68B pivotally mounted within the lower pair of pivot supports 65B. More specifically, each actuating lever 68A, 68B includes a pivot pin 69 extending transversely therethrough which has opposing ends 69*a* (only one end of each pin shown) that are each disposed within a separate support of the corresponding pair of pivot supports 65A or 65B. Each lever 68A, 68B includes a contact portion 70A, 70B, respectively, at the front end thereof that extends inwardly toward the center of the mouth portion 63 of the frame member 62 through the proximal through-hole 64A, 64B, respectively. The rear end 71A, 71B of each actuating lever 68A, 68B, respectively, contacts and acts upon the proximal switch 16, 18, respectively, as described below.

Preferably, the upper shell half 58 includes a first pair of connective posts 59 (only one shown) extending from the lower surface thereof, each post 59 including an opening 59*a* (one shown), and the lower shell half 60 includes a second pair of connective posts 61 extending from the upper surface thereof, each post 61 including a peg portion 61*a*. The pegs 61*a* of the second pair of posts 61 extend through openings 55 in the frame 62 and fit within the openings 59*a* in the first pair of posts 59 to connect the upper shell and lower shell halves 58, 60, respectively. Preferably, threaded fasteners (not shown) extend through counter-bored holes 61*b* through the second pair of posts 61 and into threaded openings 59*b* in the first pair of posts 59 so as to secure the shell halves 58, 60 together and thereby retain together the components of the mouth switch assembly 56. Alternatively, the shell halves 58, 60 may be held together merely by friction between the pegs 61*a* and openings 59*a* or by any other appropriate means, such as for example, adhesives (not shown) applied between abutting peripheral edges of the shell halves 58, 60.

Further, when the shell halves 58, 60 are thus assembled, the pivot pin 69 of each actuating lever 68A, 68B is retained within the corresponding pair of pivot supports 65A, 65B by a separate pair of retaining bars 76A (only one shown) and 76B, respectively. Each pair of retaining bars 76A, 76B extends inwardly from the inner surface of the respective shell half 68A or 68B such that the free ends thereof fit within recessed portions of the corresponding pivot supports 65A, 65B, respectively, to thereby trap the ends of the pin 69 therebetween.

The mouth switch assembly 56 functions as follows. When an object, such as a simulated item of food or utensil as described below, is inserted through the mouth opening 14 of the doll 10 and pushes against the contact portion 70A, 70B of an activating lever 68A, 68B, the contact portion 70A, 70B moves outwardly through the corresponding through-hole 64A, 64B. The outward movement of the contact portion 70A, 70B causes the lever 68A, 68B to pivot about the respective pair of supports 65A, 65B, such that the rear end 71A, 71B moves inwardly. The rear end 71A, 71B of the lever 68A, 68B pushes against the associated switch 16, 18, causing the movable portion of the switch 16, 18 to displace into contact with the stationary switch portion, thereby completing electrical connection with the circuit 22, specifically with specified input ports 23*a* of the IC chip 23. The operation of the toy doll 10 is described in further detail below.

Referring now to FIGS. 1, 2 and 12–14, the external base 24 is preferably constructed as a feeding tray assembly 28 including a feeding tray 85 on which is disposed the external switch 26, and most preferably three external switches 26 detachably connected with the electric circuit 22. Alternatively, the feeding tray assembly 28 may include any number of external switches 26. Further, the feeding tray assembly 28 has two legs 90 attached to the lower surface thereof which supports the feeding tray 85 above a surface, such as a floor or a table. Preferably, the feeding tray 85 is constructed of an upper cover plate 86 attached to a lower base plate 88. Although a two-piece feeding tray 85 is preferred, it is within the scope of the present invention to construct the feeding tray 85 as a single component or even from three or more assembled components (neither structure shown).

Referring to FIGS. 1, 2, 12 and 14, preferably, the upper cover plate 86 is molded so as to simulate the upper surface of an actual feeding tray having a plurality of simulated food items and simulated food or beverage utensils disposed thereon. The cover plate 86 preferably has three through-holes 83 extending therethrough and three storage troughs 84 formed therewithin, the purpose of each being described below. Alternatively, the cover plate 86 may have any number of through-holes 83 and troughs 84.

Figure 13:
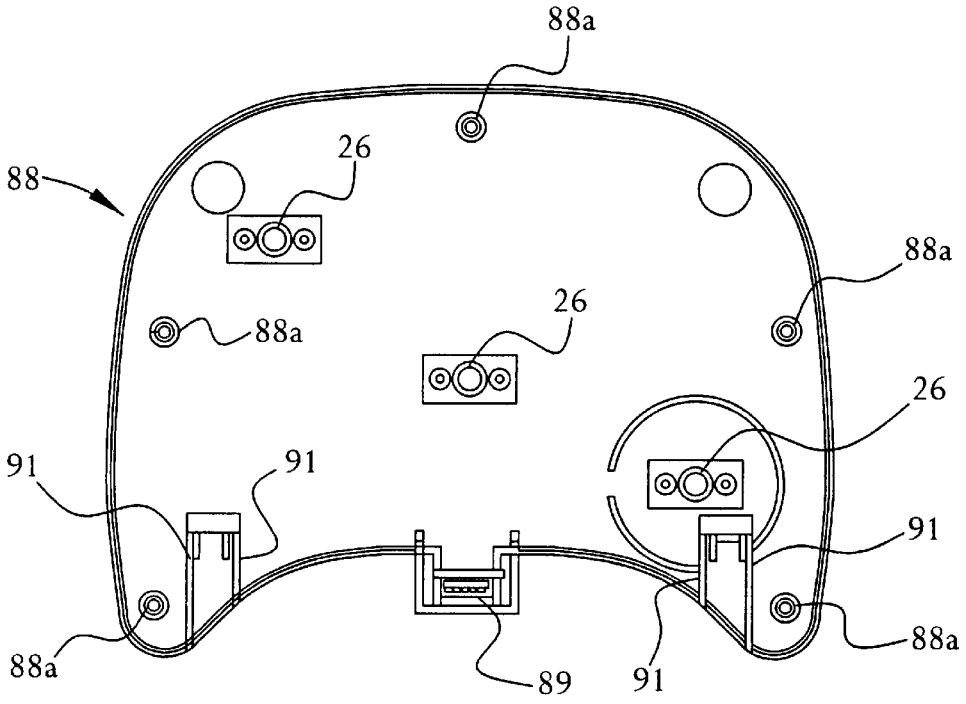
FIG. 13 is a top plan view of the lower half of the feeding tray assembly.
Figure 14:
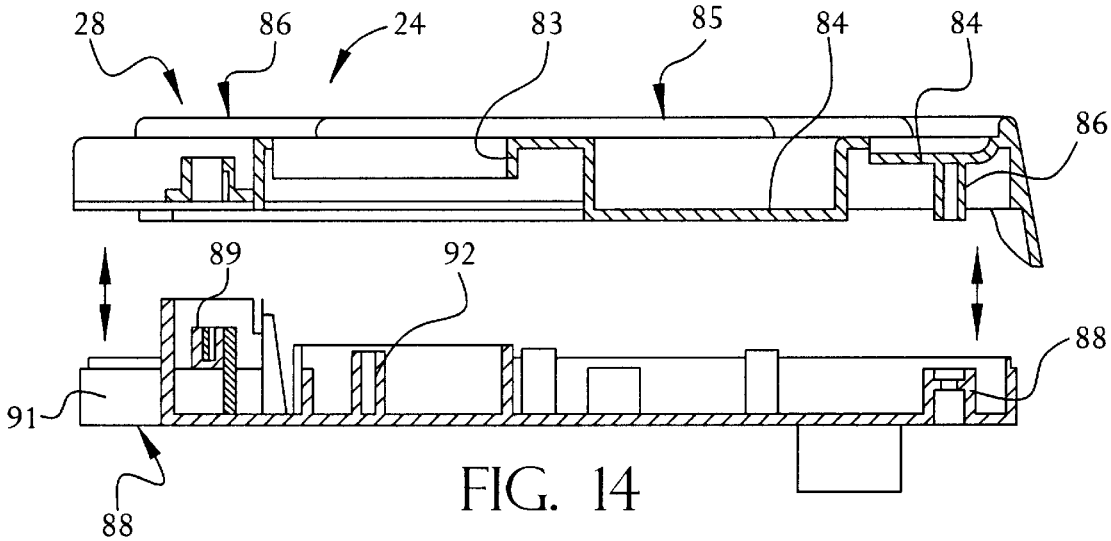
FIG. 14 is an exploded, side cross-sectional view of the feeding tray assembly shown without supporting legs.

As shown in FIGS. 2, 13 and 14, the base plate 88 is preferably a generally flat plate attached to the cover plate 86 by a plurality of threaded fasteners (not shown) extending through counter-bored holes in upwardly extending posts 88*a* and into mating, downwardly extending posts 86*a* of the cover plate 86. However, the plates 86, 88 may alternatively be connected by any other appropriate means, such as for example adhesives, rivets, a friction fit or by interlocking portions thereof. The three switches 26 are preferably disposed on the upper surface 88*b* of the base plate 88, preferably on raised pairs of raised posts 92 extending therefrom, and arranged such that the switches 26 are disposed beneath a separate one of the through-holes 83 when the plates 86, 88 are assembled together (see FIG. 2).

Figure 15:
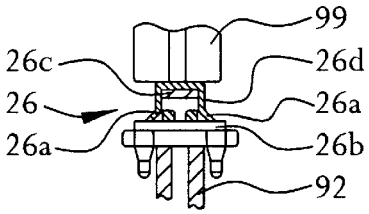
FIG. 15 is a side cross-sectional view of a preferred external switch used with the feeding tray base.

Referring to FIGS. 2, 13 and 15, preferably, the switches 26 are each a commercially available push-button switch, as described above with the first and second switches 16, 18. Most preferably, the switches 26 are constructed having at least one and preferably two stationary conductive members 26*a* fixed to a base 26*b* and a movable conductive member 26*c* disposed above the stationary members 26*a* and connected with the base 26*b* by a deformable cover 26*d* that encloses the conductive members 26*a*, 26*c*, as best shown in FIG. 15. By pushing downwardly on the movable member 26*c*, the cover 26*d* deforms so that the movable member 26*c* displaces into contact with the stationary members 26*a* to establish an electrical connection with a specific input port 23*a* of the IC chip 23. However, as with the first and second switches 16, 18, the external switches 26 may be any other type of mechanically-operated electrical switch or even another type of electrical switch, such as a proximity switch as mentioned above (none shown).

Still referring to FIGS. 2, 13 and 14, the base plate 88 further includes an electrical connector 89, preferably mounted to rearward portion thereof, which is electrically connectable with the toy doll 10 as described below. Preferably, the electrical connector is a known "5prong" type of electrical socket electrically connected with each of the switches 26 by appropriate means, such as through separate pairs of conductive cables (not shown) each connected to the stationary member 26*a* of a separate switch 26. Further, the base plate 88 preferably includes two pairs of guide rails 91 adapted to connect a seat with the feeding tray 85 as described below.

Referring to FIGS. 1, 2 and 15, the feeding tray assembly 28 further includes three activating members 93A–93C, each member 93A–93C being slidably disposed within a separate one of the through-holes 83 in the cover plate 86. Each activating member 93 has an upper contact portion 98A–98C formed to simulate a separate item of food and an actuating bar 99 (only one shown) extending downwardly from the contact portion 98A–98C. Most preferably, one contact portion 98A simulates a jar of cherries, another contact portion 98B simulates a bowl of cereal, and the other contact portion 98C simulates bowl of ice cream. The lower end of each actuating bar 99 is disposed above a proximal switch 26 so as to be contactable with the movable portion 26*c* thereof.

Each switch 26 is activated by a user pushing downwardly on the contact portion 98 of the associated activating member 93, causing the actuating bar 99 to displace the movable member 26*c* into contact with the stationary members 26*a*. The contact between the conductive members 26*a*, 26*c* of each switch 26 electrically connects the switch 26 with a specific portion of the IC chip 23 when the feeding tray assembly 28 (i.e., the external base 24) is electrically connected with the doll 10.

Figure 16:
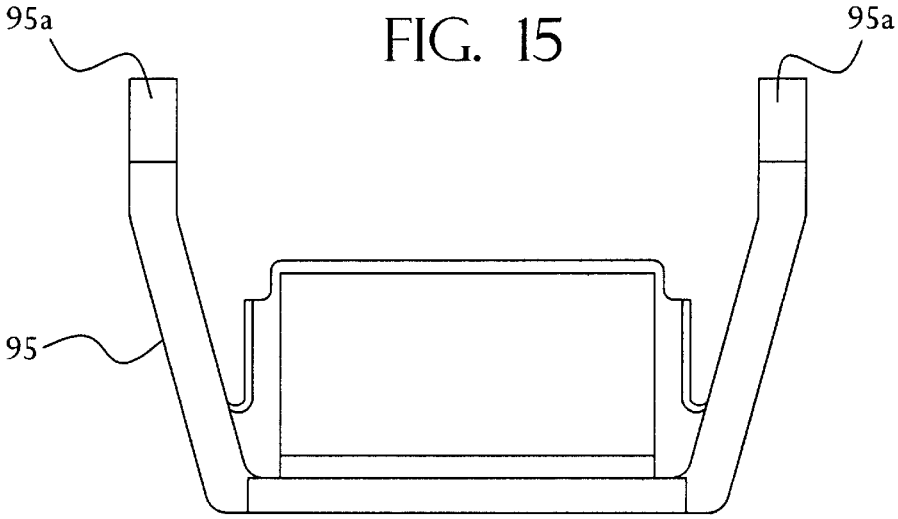
FIG. 16 is a top plan view of a seat portion of the feeding tray base.

Referring to FIGS. 2 and 16, the base 24 further includes a seat 95 configured such that the toy doll 10 is supportable thereon. The seat 95 includes two arm portions 95*a* that are each adapted to be slidably disposed within one of the pairs of guide rails 91 of the base plate 88 to connect the seat 95 to the feeding tray assembly 28. When the seat 95 is thereby connected with the feeding tray assembly 28, the base 24 is a self-supporting structure.

Figure 17:
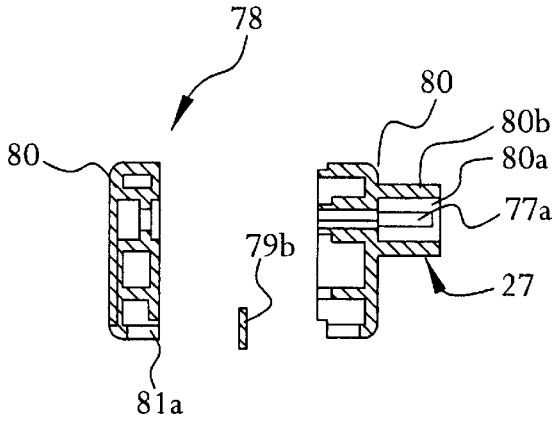
FIG. 17 is an exploded, side cross-sectional vie of a preferred electrical connective member.
Figure 18:
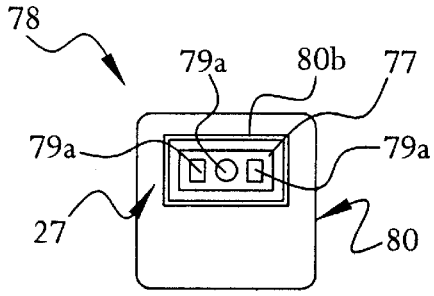
FIG. 18 is a rear plan view of the connective member.
Figure 19:
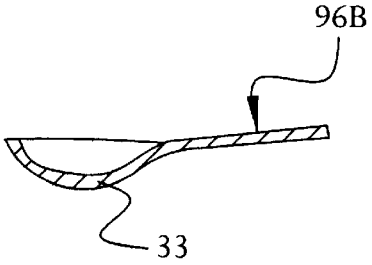
FIG. 19 is a side cross-sectional view of a simulated spoon used with the doll.
Figure 20:
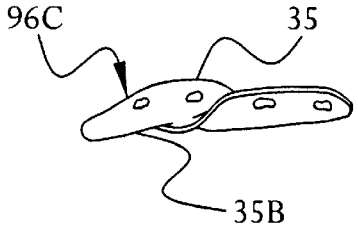
FIG. 20 is a side plan view of an object simulating two overlapping cookies used with the doll.

Referring now to FIGS. 2 and 17 and 18, preferably, the toy doll 10 further includes an electrical connective member 78 attached to the electrical socket 54 of the electrical housing 40 and having a portion thereof extending through the front of the torso 36. The electrical connective member 78 includes front and rear housing halves 80, 81 assembled together by appropriate means. The housing halves 80, 81 enclose a plurality of electrical conductive members, preferably strips of conductive metal (not shown), that extend between two openings 80*a*, 81*a* into the connective member 78 two form two electrical connections 77, 79.

Preferably, the rear housing half 81 includes a rear plug housing 81*b* extending from the rear surface thereof which encloses the first electrical connection 77 having three conductive prongs 77*a* to form a rear electrical plug 27 of the standard "three-prong" variety. Further, as best shown in FIG. 2, the bottom portions of the assembled housing halves 80, 81 form a lower plug housing portion 79*a* enclosing the second electrical connection 79, which preferably has five generally thin, conductive prongs 78*b* (only one shown), so as to form a lower electrical plug 29 of the five-prong variety. Preferably, the rear electrical plug 27 is fixedly connected with the socket 54 of the electrical housing 41, although alternatively the first plug 27 may be removably attached to the socket 54. The lower electrical plug 29 is configured to be removably attached to the electrical connector 89 of the feeding tray assembly 28.

Although the electrical connective member 78 is preferably constructed as described above and depicted in FIGS. 2, 17 and 18, the connective member 78 may alternatively be constructed as a flexible bundle of conductive wires (not shown) having either one end fixedly connected with the doll 10 or the feeding tray assembly 28 and a plug at the other end or a plug at each end so as to be removable from both the doll 10 and the external base 14. Such an alternative construction of the connective member 78 is similar to the connective cables commonly used with telecommunications equipment and computers. Furthermore, it is within the scope of the present invention to construct the electrical connective member 78 in any other appropriate manner, as long as the electrical circuit 22, particularly the IC chip 23, is connectable with the electrical connector 89 of the feeding tray assembly 28.

Referring to FIGS. 1, 2, 19 and 20, the toy doll 10 further comprises at least first and second objects 96A, 96B, each object 96A, 96B being configured to activate a separate one of the switches 16, 18 when inserted at least partially within the simulated mouth 14. Preferably, the toy doll 10 further includes a third object 96C configured to generally simultaneously activate both of the switches 16, 18 when inserted at least partially within the simulated mouth 14. Each of the objects is preferably stored in a specific, appropriately-shaped storage trough 84 of the feeding tray assembly 28 when not in use.

More specifically, the first object 96A is preferably shaped so as to simulate a drinking bottle and includes a sipper portion 97 which, when inserted into the mouth opening 14, pushes the contact portion 70A of the upper activating lever 68A upwardly and outwardly from the mouth portion 63 so as to activate the first mouth switch 18 in the manner described above. Further, the second object 96B (FIGS. 1 and 19) is preferably shaped to simulate a spoon and is configured such that when it is inserted into the mouth opening 14, a lower portion 33 thereof pushes the contact portion 70B of the lower actuating lever 68B downwardly and outwardly from the mouth portion 63 so as to activate the second mouth switch 18 as described above. Furthermore, the third object 96C (FIGS. and 20) is shaped so as to one or more cookies, preferably two overlapping cookies, and is sized such that, when inserted into the mouth opening 14, an upper surface 35A thereof pushes against the contact portion 70A of the upper lever 68A and the lower surface 35B thereof pushes against the contact portion of the lower lever 68B, thereby activating both switches 16, 18 generally simultaneously.

Although the three objects 96A–96C as described above are preferred, it is within the scope of the present invention to provide the objects 96A–96C to be configured as any other appropriate utensil or item of food. Further, it is also within the scope of the present invention to omit the third object 96C or to include other objects (not shown) in addition to the three objects 96A–96C, as long as at least two objects are provided such that one object is configured to activate the first switch 16 and not the second switch 18 and the other object is configured to activate the second switch 18 without activating the first switch 16.

Referring again to FIG. 3, as stated above, the electrical circuit 22 is preferably configured with an IC chip 23. The IC chip 23 has a plurality of input ports 23*a*, to each of which a separate switch 16, 18, or 26 is electrically connectable, and a plurality of output ports 23*b*, to which is electrically connected at least the speaker 20, and most preferably a transistor amplifier 22*a* electrically connected with the speaker 20. The chip 23 further includes an electronic memory in the form of numerous interconnected memory registers (not shown). Further, the chip 23 has a number of audio messages stored in digital format in specific series or groups of memory registers. The input ports 23*a*, which are controlled by the switches 16, 18 and 26, select specific audio messages for the chip 23 to transmit to the speaker 20. In addition to the state of the input ports 22*a*, the output of the IC chip 23 is dependent on the previous audio message transmitted by the chip 23, as described below.

Furthermore, the IC chip 23 is configured to "recognize" whenever each of the specific electrical switches 16, 18 or 26 is electrically connected with a specific input port 23*a*. The IC chip 23 also includes a digital-to-analog ("DA") convertor which converts the digital electronic signals into analog signals prior to the transmission of a message to the speaker 20 (i.e., through amplifier 22*a*). Further, the IC chip 23 is configured to randomly select from the messages stored in its internal memory and transmit the selected signals to the speaker 20 through the AD convertor. Furthermore, the chip 23 is programmed to prompt a user to activate one or more specified switches and then compare one or more activated switches 16, 18, 26 with the specified switch(es).

As described above, the user activates a single switch 16, 18 or 26 or sequence of switches 16 and 18 either by inserting an object 96A–96C within the simulated mouth 14 or by pushing downwardly upon a specific activating member 96A–96C. The switches 16, 18, 26, each being connected with a specific input port 23*a* of the chip 23, as depicted in FIG. 3, enable the chip 23 to "recognize" simulated food items or utensils selected by the user for "feeding" to the doll 10.

As is readily apparent to those skilled in the electronic and toy arts, the circuit 22 may be alternatively constructed in numerous alternative manners and still perform the required functions as described above and in further detail below. For example, the circuit 22 may be constructed with discrete electronic components (not shown) including sound storage means, such as a magnetic tape, or with "hard-wired" logic circuits, such that the doll 10 performs as described above and below. The present invention is therefore intended to embrace any alternative configuration of the circuit 22 that enables the toy doll 10 to perform as follows.

In use, the user has the option of utilizing the toy doll 10 in one of two play modes. In a first, expanded play mode, the toy doll 10 is used connected to the external base 24, i.e., the feeding tray assembly 28, as depicted in FIGS. 1 and 2. When used in the expanded mode of play, the electrical circuit 22 is connected with five switches, the two mouth switches 16, 18 and the three external switches 26, such that the doll 10 "recognizes" the three objects 96A–96C and the various simulated food portions 98A–98C of the three activating members 93A–93C disposed in the feeding tray assembly 28. In a second, more limited play mode, the toy doll 10 is used independently (not shown) of the feeding tray assembly 28 by disconnecting the second, disconnectable electrical plug 29 of the connective member 78 from the electrical connector 89 of the feeding tray assembly 28. When in the limited/independent mode of play, the electrical circuit 22 is connected with only the two mouth switches 16, 18, such that the doll 10 can only "recognize" the three objects 96A–96C. However, in either mode, the electrical circuit 22, specifically the IC chip 23 thereof, operates in a generally similar manner.

Initially, the chip 23 is in an "inactive" state until the user causes either or both of the mouth switches 16, 18 to become activated, as described above, by inserting one of the objects 96A, 96B or 96C into the mouth cavity 32. Preferably, when at least one of the switches 16, 18 is activated, the chip 23 transmits a specific message, stored in a particular one of the memory registers, to the speaker 20 such that the speaker 20 broadcasts an initial audio message, preferably in the form of a laughing or giggling sequence, so that the user is made aware that the doll 10 is "ready to play".

After the initial message is broadcast, the chip 23 randomly selects a prompt message from one of a plurality of messages stored in the memory registers of the chip 23. The prompt message is then transmitted to the speaker 20 such that the speaker 20 transmits an audio prompt message in the form of a request for a specific item of food or liquid, such as for example, "I want a cookie". If the user does not respond after the lapse of a predetermined time interval by selecting an item of food, by either inserting an object 96A, 96B, 96C into the mouth cavity 32 or by pushing upon an activating member 93 to "scoop" a simulated item of food from the feeding tray assembly 28, the chip 23 causes the speaker 20 to retransmit the particular prompt message. The doll 10 repeats the same particular request a specified number of times until either the user inserts an object 96A, 96B, 96C into the mouth cavity 32 or pushes upon one of the activating members 93A, 93B, 93C on the feeding tray assembly 28, such that one or more of the switches 16, 18 or 26 is activated. If the user does not cause one of the switches 16, 18 or 26 to be activated before the doll 10 retransmits the request the specified number of times, the circuit 22 then reverts to the inactive state.

When a switch 16, 18 or 26 has been activated by the user in response to a prompt message by the chip 23, the chip 23 compares the activated switch with the specified switch corresponding to the prompt message. If the user has caused the specified switch to be activated, the chip 23 transmits an appropriate message informing the user that the specified one of the switches has been activated, in other words, that the user has "fed" the doll 10 the desired food item or beverage. Examples of appropriate messages for this purpose are "ummmhh", "thank you" and "thanks". If the user has caused the activation of a switch other than the specified one of the switches, the chip 23 preferably transmits a message informing the user that the user has not activated the appropriate switch, such as for example "not milk, I want a cookie". Alternatively, the chip 23 may only retransmit the original prompt message after the expiration of a predetermined interval of time specified or random number of times until the user selects correctly.

Each request for an item, comparison of a selected item with the requested item, and response to a correctly selected item, with possible responses to incorrectly selected items until selection of the correct item, constitutes one "interaction sequence". Preferably, the chip 23 is programmed to perform a single "performance sequence" consisting of a random number of interaction sequences whenever "play" has been initiated, with each specific sequence being initiated by the chip 23 randomly selecting a prompt message from its memory registers. In other words, in each performance sequence, the doll 10 asks for a random number of specific items, and each item asked for is randomly selected. For example, in one performance sequence the doll 10 may ask for a cookie, and then milk, and then cherries and in another performance sequence, the doll 10 may only ask for cherries and then terminate the performance sequence. When executing a performance sequence, the doll 10 is preferably not limited to the requesting any specific item only one time, such that the doll 10 may, for example, ask for a cookie twice, either in succession or before and after other items.

After completion of each performance sequence, the IC chip 23 transmits a specific termination message stored in its memory to the speaker 20, such that an audio message is broadcast to inform the user that the performance sequence is over. Most preferably, the termination message is a specific statement, such as for example, "All done", followed by the broadcast of an appropriate song such that the user is encouraged to "sing along" with the doll 10. The chip 23 then returns to the inactive state described above until the user again activates one or both of the mouth switches 16, 18.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy doll interactive with a user, the doll comprising:

a body having an opening simulating a mouth;

two activatable electrical switches disposed proximal to the simulated mouth;

a speaker attached to the body; and an electrical circuit electrically connected with the switches and with the speaker and configured to transmit a first signal to the speaker when one of the two switches is activated and a second signal to the speaker when the other of the two switches is activated, the circuit having an electronic memory for storing a plurality of signals corresponding to audio messages and is configured to randomly select one of the stored signals from the memory and transmit the signal to the speaker;

a first object insertable into the mouth and configured to activate one of the two switches; and a second object insertable at least partially within the simulated mouth and configured to activate the other of the two switches;

one of the plurality of signals stored in the memory corresponds to an audio message prompting the user to insert the first object into the simulated mouth; and another of the plurality of signals corresponds to an audio message prompting the user to insert the second object into the simulated mouth.

2. The toy doll as recited in claim 1 wherein the electrical circuit includes an integrated circuit chip.

3. The toy doll as recited as claim 2 wherein the integrated circuit chip has a plurality of memory registers, each register storing a separate signal corresponding to a separate audio message, and is configured to randomly select a stored signal and transmit the stored signal to the speaker.

4. The toy doll as recited in claim 2 wherein the circuit chip has a first input port electrically connectable with the first switch, a second input port electrically connectable with the second switch, and a plurality of memory registers, each register storing a separate signal corresponding to a separate audio message, and the chip is configured to select a first signal from the registers when the first switch is electrically connected with the first input port and a second signal from the registers when the second switch is electrically connected with the second input port.

5. A toy doll interactive with a user, the doll comprising:

a body having an opening simulating a mouth;

two activatable electrical switches disposed proximal to the simulated mouth;

a speaker attached to the body; and an electrical circuit electrically connected with the switches and with the speaker and configured to transmit a first signal to the speaker when one of the two switches is activated and a second signal to the speaker when the other of the two switches is activated, the circuit being configured to transmit a third signal to the speaker, the third signal corresponding to an audio message prompting the user to activate a specified one of the two switches, the circuit being configured to retransmit the third signal when neither of the two switches is activated within a predetermined interval of time.

6. The toy doll as recited in claim 5 wherein the circuit has an electronic memory storing a plurality of signals, each signal corresponding to a separate audio message, and the prompt signal is randomly selected from the plurality of signals.

7. The toy doll as recited in claim 5 wherein:

the first signal corresponds to an audio message informing the user that the specified switch is activated; and the second signal corresponds to an audio message informing the user that the other switch is activated.

8. A toy doll interactive with a user, the doll comprising:

a body having an opening simulating a mouth;

two activatable electrical switches disposed proximal to the simulated mouth;

a speaker attached to the body; and an electrical circuit electrically connected with the switches and with the speaker and configured to transmit a first signal to the speaker when one of the two switches is activated and a second signal to the speaker when the other of the two switches is activated, the circuit being configured to transmit a third signal to the speaker, the third signal corresponding to an audio message prompting the user to activate a specified one of the two switches, the circuit being configured to compare an activated one of the two switches with the specified switch;

the first signal is transmitted to the speaker when the activated switch corresponds to the specified switch; and the second signal is transmitted to the speaker when the activated switch is a switch other than the specified switch.

9. A toy doll interactive with a user, the doll comprising:

a body having an opening simulating a mouth;

two activatable electrical switches disposed proximal to the simulated mouth;

a speaker attached to the body; and an electrical circuit electrically connected with the switches and with the speaker and configured to transmit a first signal to the speaker when one of the two switches is activated and a second signal to the speaker when the other of the two switches is activated, a first object configured to activate one of the two switches when inserted at least partially within the simulated mouth; and a second object configured to activate another one of the two switches when inserted at least partially within the simulated mouth.

10. The toy doll as recited in claim 9 further comprising a third object configured to activate both of the switches when inserted at least partially within the simulated mouth.

11. The toy doll as recited in claim 9 wherein the objects simulate one of a utensil and an item of food.

12. A toy doll interactive with a user, the doll comprising:

a body having an opening simulating a mouth;

two activatable electrical switches disposed proximal to the simulated mouth;

a speaker attached to the body; and an electrical circuit electrically connected with the switches and with the speaker and configured to transmit a first signal to the speaker when one of the two switches is activated and a second signal to the speaker when the other of the two switches is activated, a base disposed externally of and detachably connected with the torso and having an external switch electrically connected with the circuit.

13. The toy doll as recited in claim 12 wherein the base simulates a feeding tray and has a movable member simulating an item of food, the simulated item being configured to activate the external switch.

14. A toy doll comprising:

a body;

a base disposed externally of and detachably connected with the body and having an activatable electrical switch;

a speaker attached to one of the body and the base, the base simulating a feeding tray and having a movable member simulating an item of food, the simulated item being configured to activate the external switch; and an electrical circuit connected with the switch and with the speaker and configured to transmit a signal to the speaker when the switch is activated.

15. The toy doll as recited in claim 14 wherein the circuit includes an integrated circuit chip.

16. The toy doll as recited in claim 14 wherein the base has another switch connected with the circuit and the circuit is configured to transmit another signal to the speaker when the other switch is activated.

17. A toy doll interactive with a user, the doll comprising:

a body;

a speaker connected with the body;

two activatable electrical switches connected with the body;

an electrical circuit connected with the two switches and the speaker and configured to:

transmit a first electrical signal to the speaker such that the speaker transmits an audio message prompting the user to activate a specified one of the two switches;

compare an activated one of the two switches with the specified switch; and transmit a second signal to the speaker when the activated switch corresponds to the specified switch and a third signal to the speaker when the activated switch is one of the two switches other than the specified switch.

18. The toy doll as recited in claim 17 wherein the circuit has an electrical memory storing a plurality of signals, the first signal being randomly selected from the plurality of signals.

19. The toy doll as recited in claim 17 wherein:

the second signal corresponds to an audio message informing the user that the specified switch was activated; and the third signal corresponds to an audio message informing the user that the switch other than the specified switch was activated.

20. The toy doll as recited in claim 17 wherein the circuit is configured to transmit a fourth signal to the speaker when the activated switch corresponds to the specified switch and to retransmit the first signal when the activated switch is the switch other than the specified switch.

21. The toy doll as recited in claim 20 wherein the fourth signal corresponds to an audio message prompting the user to activate another specified one of the switches.

22. The toy doll as recited in claim 17 wherein the circuit is configured to retransmit the first signal after the expiration of a predetermined time interval when neither of the two switches is activated.

23. The toy doll as recited in claim 17 further comprising:

a first object configured to activate one of the two switches; and a second object configured to activate another of the two switches.

* * * * *